US011561014B2

(12) United States Patent
Kim

(10) Patent No.: US 11,561,014 B2
(45) Date of Patent: Jan. 24, 2023

(54) AIR CONDITIONER INCLUDING A HEAT EXCHANGER

(71) Applicant: Samsung Electronics Co., Ltd, Suwon-si (KR)

(72) Inventor: Hyun Young Kim, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 263 days.

(21) Appl. No.: 16/085,544

(22) PCT Filed: Mar. 16, 2017

(86) PCT No.: PCT/KR2017/002824
§ 371 (c)(1),
(2) Date: Sep. 14, 2018

(87) PCT Pub. No.: WO2017/160087
PCT Pub. Date: Sep. 21, 2017

(65) Prior Publication Data

US 2020/0300482 A1 Sep. 24, 2020

(30) Foreign Application Priority Data

Mar. 16, 2016 (JP) ..... JP2016-052942

(51) Int. Cl.
*F24F 1/0067* (2019.01)
*F28F 1/12* (2006.01)
(Continued)

(52) U.S. Cl.
CPC ..... *F24F 1/14* (2013.01); *F24F 1/0067* (2019.02); *F28F 1/128* (2013.01); *F28F 1/325* (2013.01)

(58) Field of Classification Search
CPC .. F24F 1/0047; F24F 1/14; F28F 1/128; F28F 1/325; F28F 2215/08
See application file for complete search history.

(56) References Cited

U.S. PATENT DOCUMENTS 4,705,105 A * 11/1987 Cur ..... F28F 1/325 165/151
4,709,753 A 12/1987 Reifel
(Continued)

FOREIGN PATENT DOCUMENTS

EP 2015018 A1 1/2009
EP 2219002 A1 8/2010
(Continued)

OTHER PUBLICATIONS

Machine Translation of Nam Description (Year: 2007).*
(Continued)

*Primary Examiner* — Paul Alvare

(57) ABSTRACT

An air conditioner including a heat exchanger according to an aspect of the present disclosure, the heat exchanger includes a refrigerant pipe, and a plurality of fins including a first fin and a second fin spaced apart from each other in an extending direction of the refrigerant pipe, wherein the first fin includes a flat portion and a cut-up member protruding in an arrangement direction of the second fin in the flat portion, and the height of the cut-up member in the extension direction is between 0.5 and 0.7 times the distance between the first fin and the second fin.

10 Claims, 26 Drawing Sheets

(51) Int. Cl.
*F28F 1/32* (2006.01)
*F24F 1/14* (2011.01)

(56) References Cited

U.S. PATENT DOCUMENTS

| | | | | | |
|---|---|---|---|---|---|
| 4,907,646 | A * | 3/1990 | Aoyagi | F28F 1/325 165/151 |
| 5,035,052 | A * | 7/1991 | Suzuki | F28F 1/325 29/890.046 |
| 5,553,663 | A | 9/1996 | Yu | |
| 5,697,432 | A * | 12/1997 | Yun | F28F 1/325 165/151 |
| 5,755,281 | A * | 5/1998 | Kang | F28F 1/325 165/151 |
| 5,775,413 | A * | 7/1998 | Kawanabe | F28F 1/32 165/151 |
| 6,026,893 | A * | 2/2000 | Jung | F28F 1/325 165/151 |
| 6,142,220 | A * | 11/2000 | Motegi | F28F 1/325 165/135 |
| 6,227,289 | B1 * | 5/2001 | Yokoyama | F28F 1/325 165/151 |
| 6,585,037 | B2 * | 7/2003 | Jin | F28F 1/325 165/151 |
| 7,082,989 | B2 * | 8/2006 | Kobayashi | F28D 1/0477 165/181 |
| 7,337,831 | B2 * | 3/2008 | Torii | F28F 1/325 165/109.1 |
| 2007/0151716 | A1 * | 7/2007 | Lee | F28F 17/005 165/151 |
| 2009/0084129 | A1 * | 4/2009 | Kim | F25B 39/00 62/502 |
| 2009/0308585 | A1 * | 12/2009 | Chen | F28D 1/0475 165/185 |
| 2010/0205993 | A1 * | 8/2010 | Matsuda | F24F 1/0063 62/259.1 |
| 2018/0306533 | A1 * | 10/2018 | Alahyari | F28F 19/006 |

FOREIGN PATENT DOCUMENTS

| | | | | |
|---|---|---|---|---|
| EP | 2902717 | A1 | 8/2015 | |
| GB | 2453234 | A | 4/2009 | |
| JP | H02-10097 | A | 1/1990 | |
| JP | 02217792 | * | 8/1990 | F28F 1/32 |
| JP | H02-242092 | A | 9/1990 | |
| JP | 09-049641 | A | 2/1997 | |
| JP | H09-49695 | A | 2/1997 | |
| JP | H09-96498 | A | 4/1997 | |
| JP | H10-185359 | A | 7/1998 | |
| JP | 2002-071289 | A | 3/2002 | |
| JP | 2003130567 | A * | 5/2003 | F28F 1/325 |
| JP | 2009-198055 | A | 9/2009 | |
| JP | 2012-093073 | A | 5/2012 | |
| JP | 2015-140990 | A | 8/2015 | |
| KR | 10-0128678 | B1 | 4/1998 | |
| KR | 10-0182542 | B1 | 5/1999 | |
| KR | 10-0266102 | B1 | 9/2000 | |
| KR | 20070014322 | A * | 2/2007 | |

OTHER PUBLICATIONS

Machine Translation of Ichikawa Description (Year: 2003).*
Machine Translation of Yokoyama Description from J-Plat-Pat (Year: 1990).*
European Patent Office, "Supplementary European Search Report," Application No. EP17766988 4, dated Jan. 18, 2019, 7 pages.
International Search Report dated Jul. 18, 2017 in connection with International Patent Application No. PCT/KR2017/002824.
Written Opinion of the International Searching Authority dated Jul. 18, 2017 in connection with International Patent Application No. PCT/KR2017/002824.
Communication pursuant to Article 94(3) EPC dated Apr. 19, 2021 in connection with European Application No. 17766988.4, 6 pages.
Notice Requesting Submission of Opinion dated Mar. 19, 2021 in connection with Korean Application No. 10-2018-7022534, 17 pages.
Notice of Decision for Rejection dated Sep. 17, 2021 in connection with Korean Patent Application No. 10-2018-7022534, 9 pages.
Notice of Decision of Final Rejection dated Nov. 15, 2021 in connection with Korean Patent Application No. 10-2018-7022534, 8 pages.
Notice of Reasons for Refusal dated Dec. 10, 2019, in connection with Japanese Application No. 2016-052942, 13 pages.

* cited by examiner

AIR CONDITIONER INCLUDING A HEAT EXCHANGER

CROSS-REFERENCE TO RELATED APPLICATIONS

This application is a 371 of International Application No. PCT/KR2017/002824, filed Mar. 16, 2017, which claims priority to Japanese Patent Application No. 2016-052942 filed Mar. 16, 2016, the disclosures of which are herein incorporated by reference in their entirety.

BACKGROUND

1. Field

The disclosure relates to a heat exchanger of an air conditioner.

2. Description of Related Art

Conventionally, in a so-called fin-and-tube type heat exchanger, in order to increase the heat exchange efficiency, a cut-up member is provided not in a simple plate-like fin but in a spacing direction from each fin.

For example, when air passes through a flat-plate-shaped fin without a cut-up member, a temperature boundary layer is formed from an air inlet end of the fin, and the temperature boundary layers of each fin come into contact with each other at a position spaced a predetermined distance from the air inlet to an air outlet. As a result, the local heat transfer coefficient becomes lower at the same time as the temperature boundary layer develops, and the heat transfer coefficient becomes constant from a point where the temperature boundary layers contact with each other. On the other hand, when the cut-up member is formed on the fin, a new temperature boundary layer also develops at the air inlet end of each cut-up member, so that a high local heat transfer coefficient may be maintained at each position. Therefore, the total average heat transfer coefficient of the fin having the cut-up member may be made larger than the average heat transfer coefficient of the flat fin.

In addition, the average heat transfer coefficient as described above is influenced not only by the shape and size of the cut-up member but also by the spacing of refrigerant pipes passing through the fins.

SUMMARY

If the height of the cut-up member becomes excessively large, the distance between the adjacent fins and the cut-up member becomes excessively small, thus the ventilation resistance becomes large. In this case, since it becomes difficult for air to pass between the fin and the cut-up member, the pressure loss becomes large and the energy efficiency is lowered.

In addition, in order to further improve the heat transfer coefficient in the presence of the cut-up member, there is still room for improvement as to how to arrange the refrigerant pipe.

It is an object of the present disclosure to provide a heat exchanger capable of increasing the effect of promoting heat transfer with air and suppressing an increase in the ventilation resistance to the greatest extent possible to solve the above problem.

Technical Solution

In an air conditioner including a heat exchanger according to an aspect of the present disclosure, the heat exchanger includes a refrigerant pipe and a plurality of fins including a first fin and a second fin which are spaced apart from each other in an extension direction of the refrigerant pipe, wherein the first fin includes a flat portion and a cut-up member protruding in an arrangement direction of the second fin in the flat portion, and the height of the cut-up member in the extension direction is between 0.5 and 0.7 times the distance between the first fin and the second fin.

Also, a diameter of the refrigerant pipe is defined as D, the diameter of the refrigerant pipe satisfies 4.5 mm≤D≤5.5 mm.

Also, the refrigerant pipe includes a plurality of the refrigerant pipes, and the plurality of refrigerant pipes include a first refrigerant pipe and a second refrigerant pipe spaced apart from each other in a first direction that is an extension direction of the plurality of fins, a distance from the center of the first refrigerant pipe to the center of the second refrigerant pipe is defined as Dp, and the distance from the center of the first refrigerant pipe to the center of the second refrigerant pipe satisfies D*2.5≤Dp≤D*3.5.

Also, the plurality of refrigerant pipes further include a third refrigerant pipe spaced apart from the first refrigerant pipe in a second direction perpendicular to the first direction, wherein a distance from the center of the first refrigerant pipe to the center of the third refrigerant pipe in the second direction is defined as Lp, and the distance from the center of the first refrigerant pipe to the center of the third refrigerant pipe in the second direction satisfies D*2.0≤Lp≤D*2.5.

Also, the cut-up member includes a body portion spaced apart from the flat portion so that a slit is formed between the flat portion and the cut-up member, and an end portion connected to the flat portion at both ends of the body portion is formed to be inclined from 40 to 50 degrees with respect to the flat portion.

Also, the cut-up member includes a body portion spaced apart from the flat portion so that a slit is formed between the flat portion and the cut-up member, and an end portion connected to the flat portion at both ends of the body portion is formed to be inclined from 40 to 50 degrees with respect to the flat portion.

Also, the cut-up member protrudes from only one side of the flat portion

Also, the first fin further includes a through hole through which the refrigerant pipe passes, and the cut-up member includes a plurality of cut-up members, wherein a plurality of body portions of the plurality of cut-up members extends in a direction corresponding to a longitudinal direction of the first fin, and a plurality of end portions of the plurality of cut-up members is provided so as to surround the peripheries of the through hole.

Also, the longitudinal direction of the first fin is defined as a first direction and a direction being perpendicular to the first direction in which air flows into the heat exchanger is defined as a second direction, wherein the plurality of cut-up members includes a first cut-up member adjacent to the center of the through hole in the second direction, and a second cut-up member adjacent to an edge of the first fin in the second direction.

Also, an angle of an end of the first cut-up member with respect to the second direction is smaller than an angle of an end of the second cut-up member with respect to the second direction Also, the angle of the end of the second cut-up member with respect to the second direction is formed between 20 degrees and 50 degrees with respect to the second direction.

Also, the plurality of cut-up members protrudes at the same height with respect to the flat portion In an air conditioner including a heat exchanger according to another aspect of the present disclosure, the heat exchanger includes a refrigerant pipe extending in a first direction and a fin extending in a second direction orthogonal to the first direction through which the refrigerant pipe passes through, and when air flows into the fin in a third direction orthogonal to the first direction and the second direction, the fin includes a plurality of cut-up members having a first cut-up member protruding in the first direction and disposed on the inflow side of the air on the fin, and a second cut-up member protruding in the first direction and disposed on the outflow side of the air, and an area of the fin where the first cut-up member is disposed is smaller than an area of the fin where the second cut-up member is disposed.

Also, an extension length of the first cut-up member in the second direction is shorter than an extension length of the second cut-up member in the second direction.

Also, the refrigerant pipe includes a plurality of the refrigerant pipes, and the plurality of refrigerant pipes include a first refrigerant pipe and a second refrigerant pipe spaced apart in the second direction, and the plurality of cut-up members are disposed between the center of the first refrigerant pipe and the center of the second refrigerant pipe with respect to the second direction, and the second cut-up member extends in the second direction adjacent to the center of the first refrigerant pipe than the first cut-up member.

Also, the first cut-up member and the second cut-up member are respectively provided in plural, and the total number of the first cut-up members is smaller than the total number of the second cut-up members.

Advantageous Effects

In accordance with the heat exchanger of the present disclosure, it is possible to optimize both the heat transfer effect with air and the effect of suppressing an increase in the ventilation resistance.

DETAILED DESCRIPTION

Figure 1:
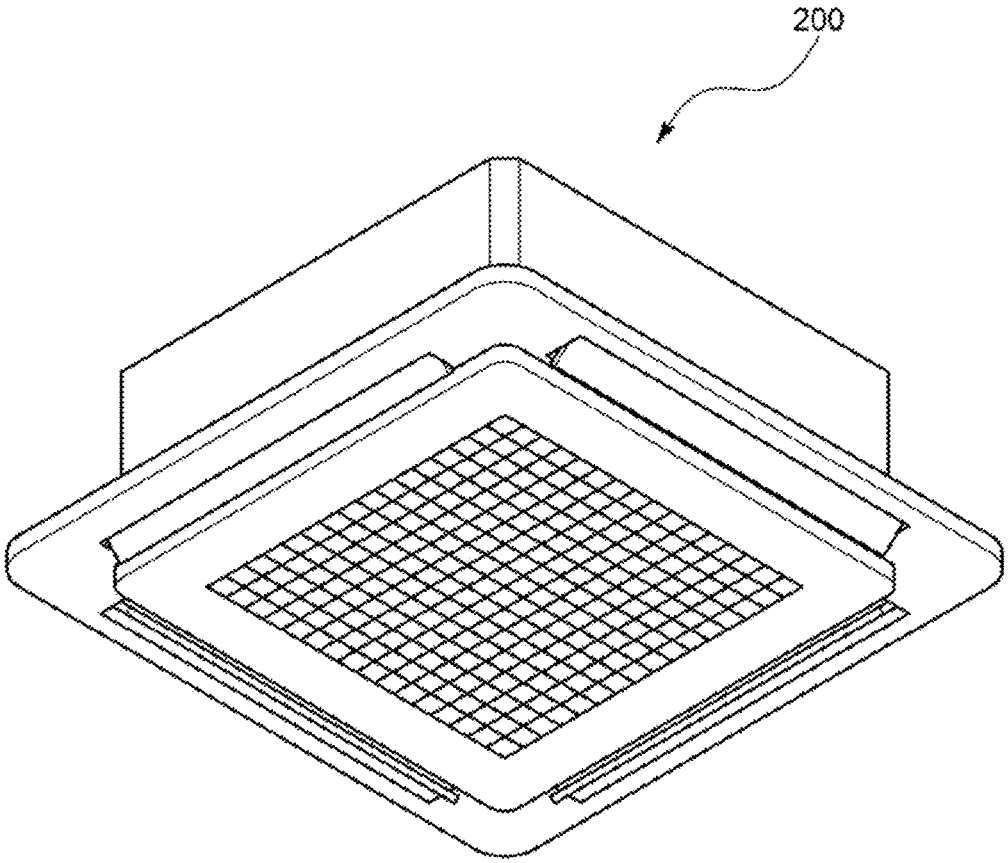
FIG. 1 is a schematic perspective view showing an indoor unit of a 4-way cassette using a heat exchanger according to an embodiment of the disclosure.
Figure 2:
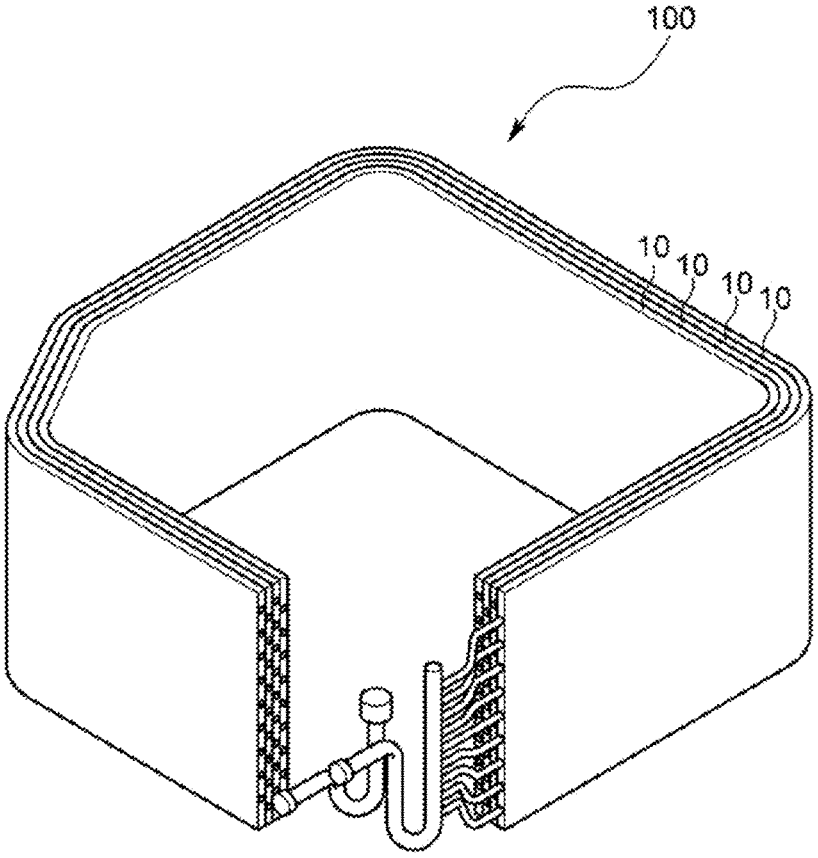
FIG. 2 is a schematic perspective view showing the entirety of a heat exchanger according to an embodiment of the disclosure.

A heat exchanger 100 according to an embodiment of the present disclosure and an air conditioner using the heat exchanger 100 will be described with reference to the drawings. As shown in FIGS. 1 and 2, the heat exchanger 100 of the present disclosure is installed, for example, in a ceiling-mounted indoor unit 200. More specifically, the heat exchanger 100 is installed so as to surround the periphery of an outlet port of a turbo fan, which is not shown.

As shown in FIG. 2, the heat exchanger 100 is a fin-and-tube type. The heat exchanger 100 has a plurality of flat heat exchanger elements 10 stacked in the thickness direction. In the present disclosure, four of the heat exchanger elements 10 are layered in the thickness direction of the heat exchanger element 10, and each of them is bent to form the quadrangular column-like heat exchanger 100 having rounded corners.

Figure 3:
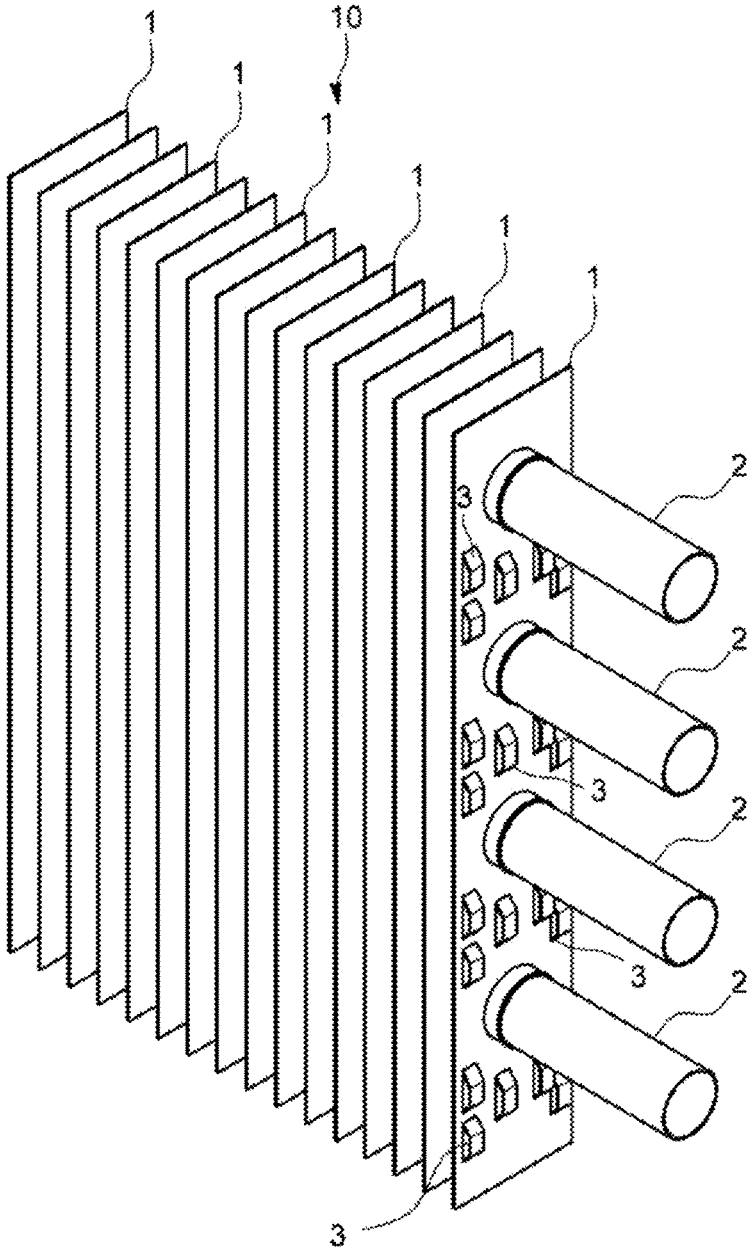
FIG. 3 is a schematic perspective view showing an enlarging a part of a heat exchanger according to an embodiment of the disclosure.

As shown in FIGS. 2 and 3, the heat exchanger element 10 is composed of a refrigerant pipe 2 and a plurality of fins 1 arranged in a horizontal direction and being an aluminum thin plate extending in the vertical direction.

The refrigerant pipe 2 is provided so as to pass through the plurality of fins 1, and refrigerant flows into the inside of the refrigerant pipe 2, and is configured to exchange heat with the air flow passing through the heat exchanger 100 through the outer surface of the refrigerant pipe 2 and the surface of the fin 1.

The refrigerant pipe 2 is provided at predetermined intervals in the vertical direction which is a short direction with respect to the fins 1, as shown in the sectional view of the heat exchanger element 10 in FIG. 3. That is, a direction, which is the air flow to the heat exchanger 100, is a column direction (horizontal direction) in which the heat exchanger elements 10 are stacked, and the direction perpendicular to the column direction is set in the short direction (vertical direction), and a penetration position of the refrigerant pipe 2 with respect to the fin 1 is set at a predetermined interval with respect to each direction.

Figure 4:
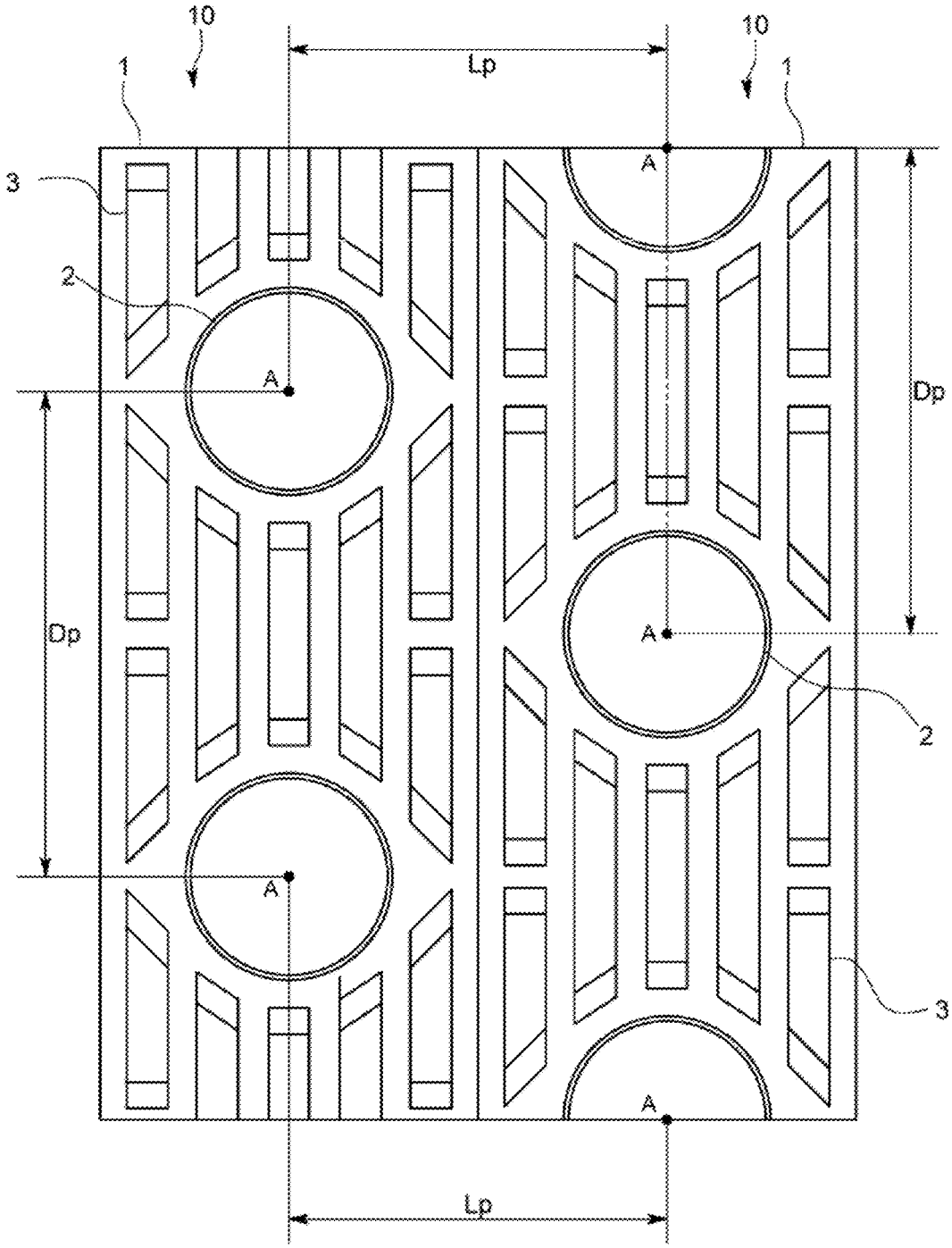
FIG. 4 is a schematic diagram showing an enlarged portion of a part of a fin according to an embodiment of the disclosure.

More specifically, as shown in FIG. 4, when one of the heat exchanger elements 10 is noted, the one heat exchanger element 10 is provided at predetermined intervals so that the distance between the axial centers of each of the refrigerant pipes 2 with respect to the short direction is set to a pitch Dp (width or separation distance from each of the refrigerant pipes 2).

Also, when two of the heat exchanger elements 10 are noted, the two heat exchanger elements 10 are provided at predetermined intervals so that the axial distances of the refrigerant pipes 2 in the column direction become a column pitch Lp. Here, in the adjacent heat exchanger element 10, the penetration positions of the refrigerant pipe 2 are crossed when viewed along the column direction.

The fin 1 is provided with a plurality of cut-up members 3 standing up from a flat portion in the separation direction of the respective fins 1. That is, the fin 1 may be provided such that an aluminum plate is press-worked so that a part thereof is sheared and stands in a direction perpendicular to the flat portion.

Further, in the present embodiment, each of the cut-up members 3 protrudes from only one side of the flat portion of the fin 1. By doing so, it is possible to reduce the number of steps for press working and to improve the productivity.

Figure 5:
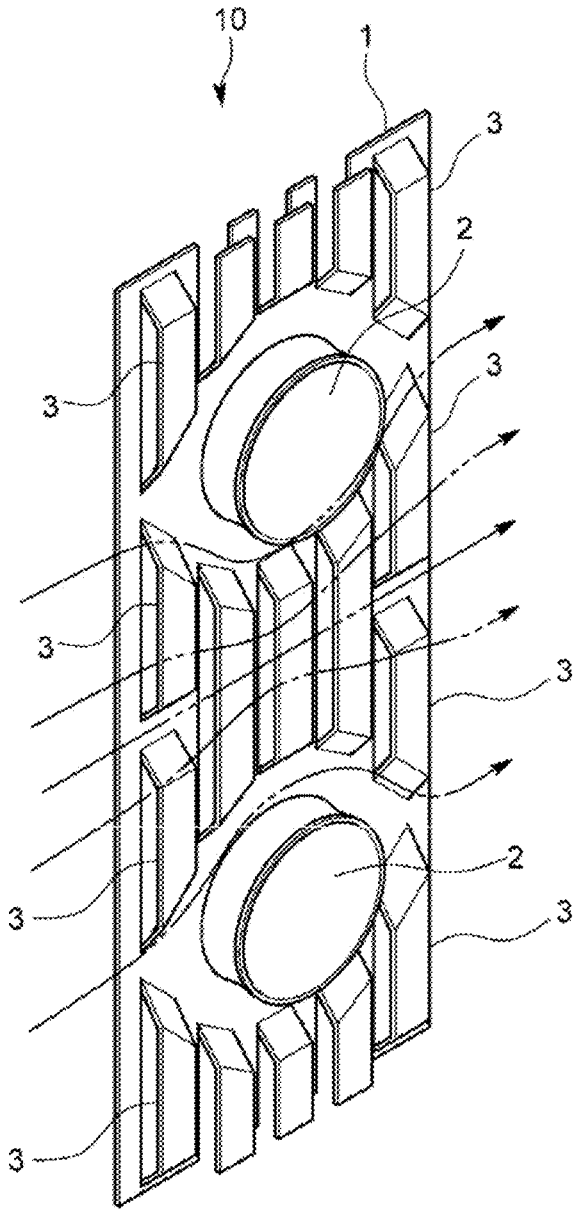
FIG. 5 is a schematic perspective view showing the structure of a fin and the air flow in the embodiment of the disclosure.
Figure 6A:
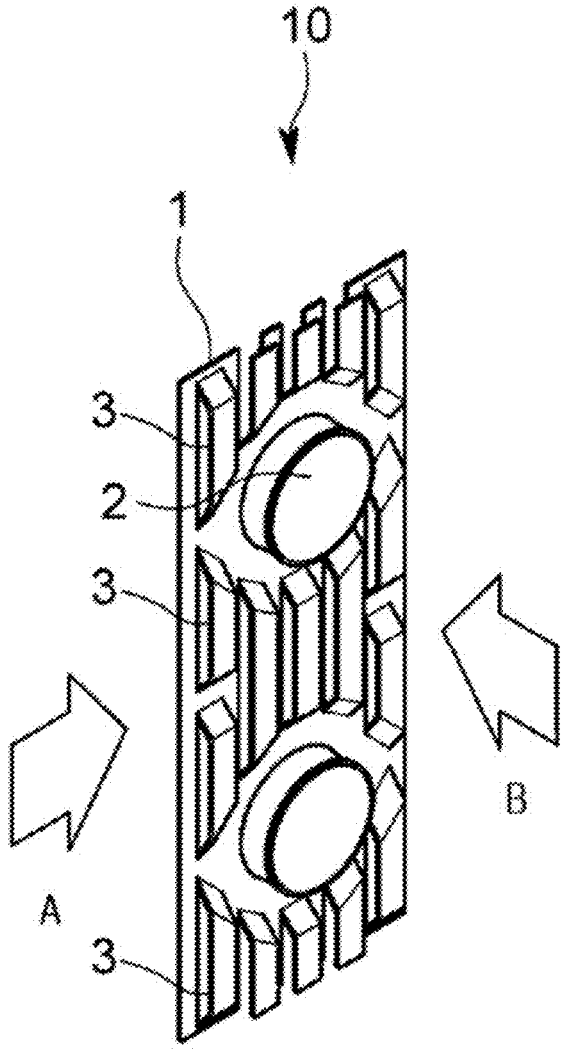
FIGS. 6A to 6C are schematic views showing the dimensions of fins in an embodiment of the disclosure.
Figure 6B:
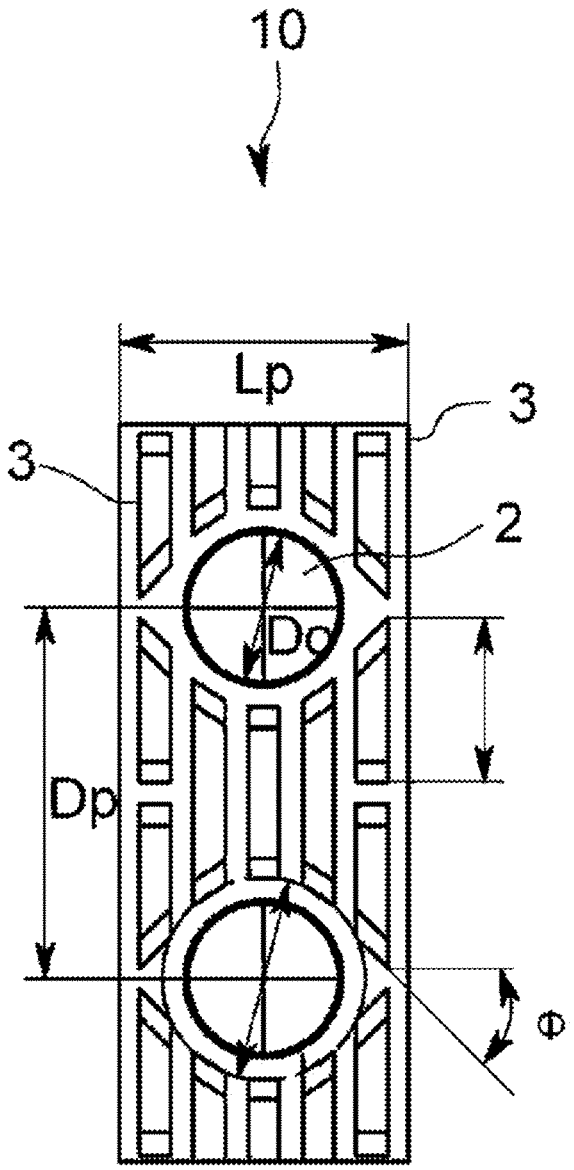
Figure 6C:
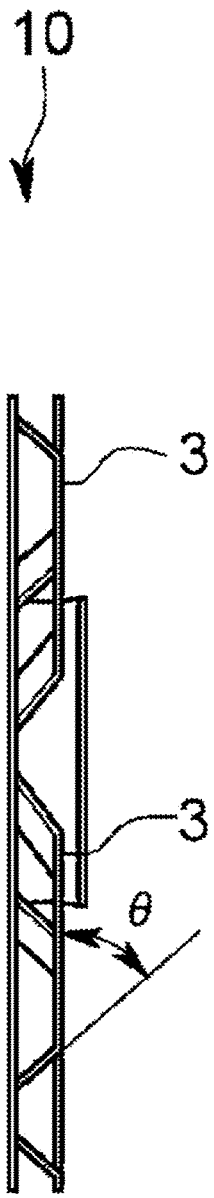

As shown in FIGS. 5 to 6C, the cut-up member 3 has a length of about half of the short pitch Dp in the column direction (up-and-down direction) with respect to the flat portion of the fin 1. In addition, the width of the cut-up member 3 in the column direction is set to about ¼ of the outer diameter of the refrigerant pipe 2.

Figure 7:
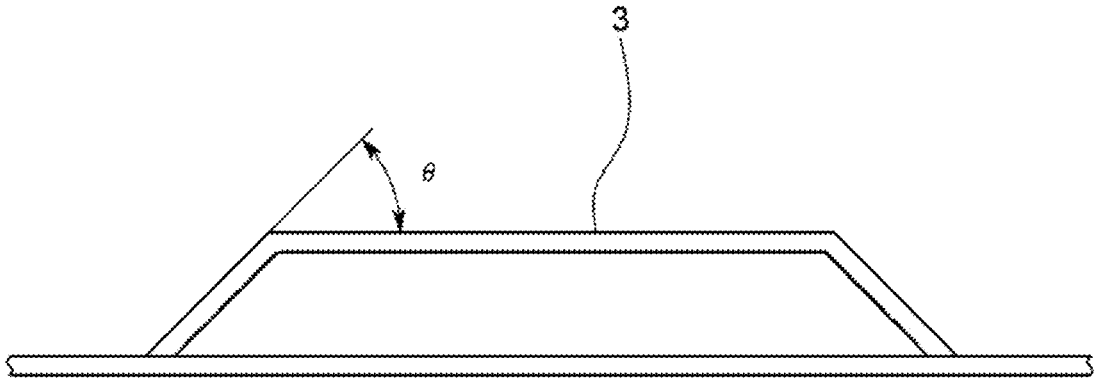
FIG. 7 is a schematic view showing the standing angle of a cut-up member in an embodiment of the disclosure.

As shown in FIGS. 6C and 7, an upper end and a lower end of the cut-up member 3 are formed obliquely so as to form a predetermined angle with respect to the flat portion (or the body portion) of the fin 1, and a center portion of the cut-up member 3 is formed so as to be parallel to the flat portion of the fin 1.

More specifically, a standing-up side angle between an end on the short-side direction of the cut-up member 3 and the flat plate portion of the fin 1 is configured to be θ which is set to be $40 \leq \leq \theta \leq \leq 50$.

Figure 8:
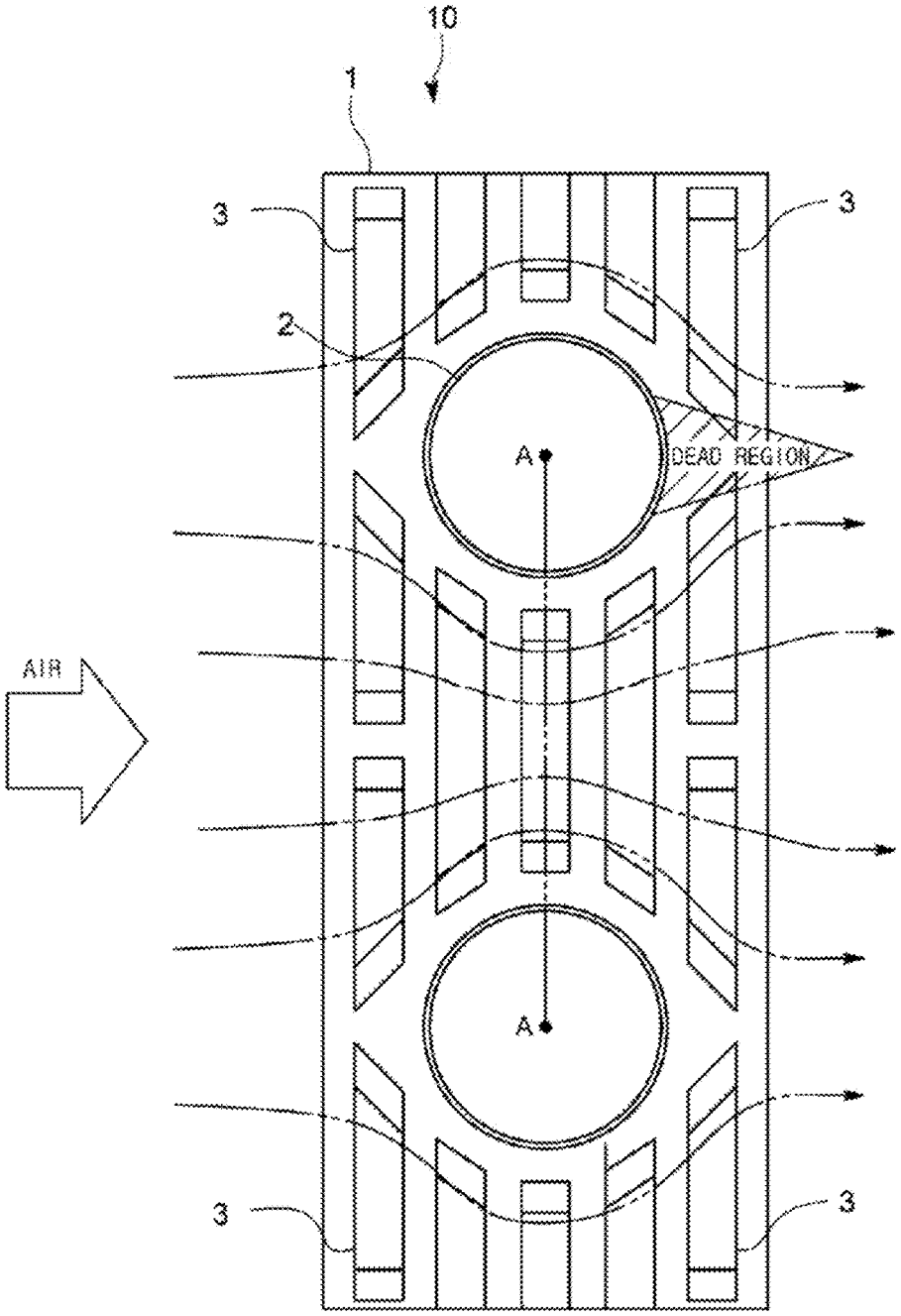
FIG. 8 is a schematic diagram showing a dead region of the air flow in an embodiment of the disclosure.

Also, as shown in FIG. 8, the shape of the upper end portion or the lower end portion of the cut-up member 3 provided as about half-circle alone an outer circumference of the refrigerant pipe 2 when the upper end portion or the lower end portion of the cut-up member 3 are connected to each other. That is, the fin 1 may include a through hole (not shown) through which the refrigerant pipe 2 passes, and the cut-up member 3 may surround the through hole (not shown).

The cut-up member 3 disposed on an air outlet side (the right side of the refrigerant pipe 2 in FIG. 8) with respect to a center A of the refrigerant pipe 2, a gap between the lower end portion of the cut-up member 3 disposed on the upper side of the refrigerant pipe 2 and the upper end of the cut-up member 3 disposed on the lower side of the refrigerant pipe 2 is provided such that the air inlet side is larger than the adjacent air outlet side.

A dead region may be formed in a downstream side (the right side of the refrigerant pipe 2 in FIG. 8) of the refrigerant pipe 2 because there is no air flow if the upper end or the lower end of the cut-up member 3 is not formed. The cut-up member 3 disposed on the air outflow side may be formed to have a narrow interval so that the upper end or the lower end of the cut-up member 3 is disposed to the inside of the dead region.

An angle formed by the upper end portion or the lower end portion of each of the cut-up members 3 in the column direction (horizontal direction) gradually decreases from the inlet side of the air flow (left side edge in FIG. 8) to the apex portion (A-A line portion) of the refrigerant pipe 2, and then increases again.

An angle formed by the column direction and the upper end or the lower end of the cut-up member 3 disposed on the air outflow side is set to be larger than an angle formed by the upper end portion or the lower end portion of the cut-up member 3 disposed on the center A of the refrigerant pipe 2 and the column direction. An angle range Φ of the cut-up member 3 disposed on the air outflow side is set to be not less than 20 degrees and not more than 50 degrees.

This makes it easier for the air flow to flow toward the air outflow side of the refrigerant pipe 2, thereby making it possible to reduce the range of the dead region and to reduce an area of the fin 1 that does not contribute to the heat exchange which increases the heat exchange efficiency.

Next, the change in the heat transfer coefficient due to the formation of the cut-up member 3 in the fin 1 will be described.

Figure 9A:
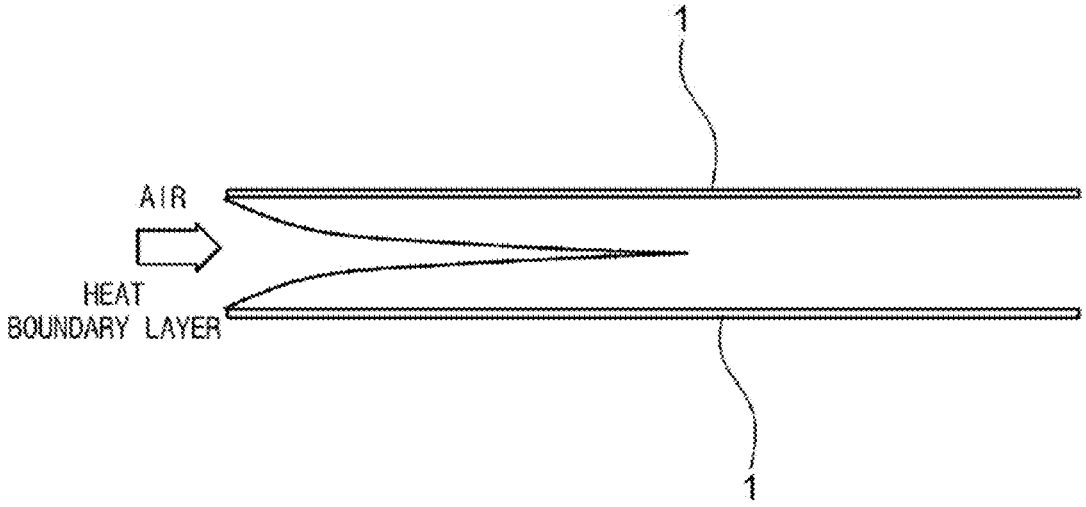
FIGS. 9A and 9B are schematic views showing the change of the heat transfer coefficient and boundary layer formed by a fin without a cut-up member in an embodiment of the disclosure.
Figure 9B:
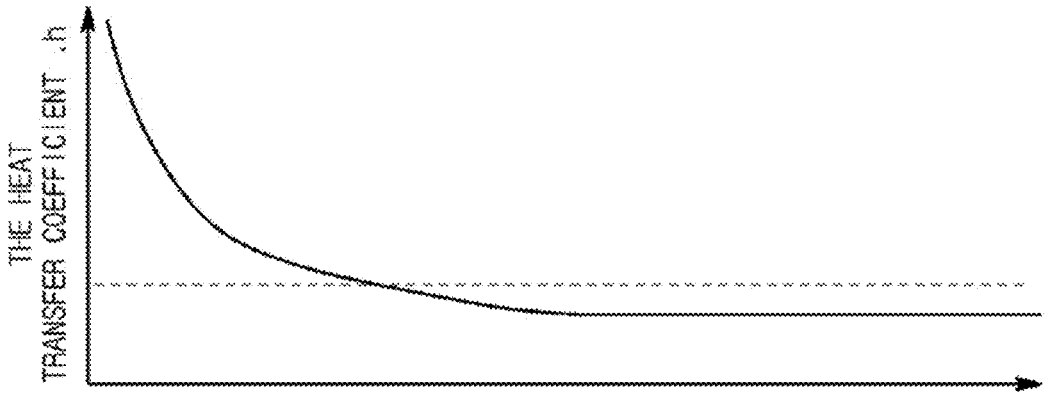

FIGS. 9A and 9B are graphs that show the development of a temperature boundary layer in the case where the fin 1 without the cut-up member 3 is provided for every predetermined pitch and the magnitude of the heat transfer coefficient at each location from the air inlet end to the air outlet end.

In this case, the temperature boundary layer is developed from the fins 1 on both sides, and the temperature boundary layer developed from each of the fins 1 reaches half the distance from the air inflow end to the air outflow end. As a result, the heat transfer coefficient becomes constant after the point where each temperature boundary layer comes into contact with each other.

Figure 10A:
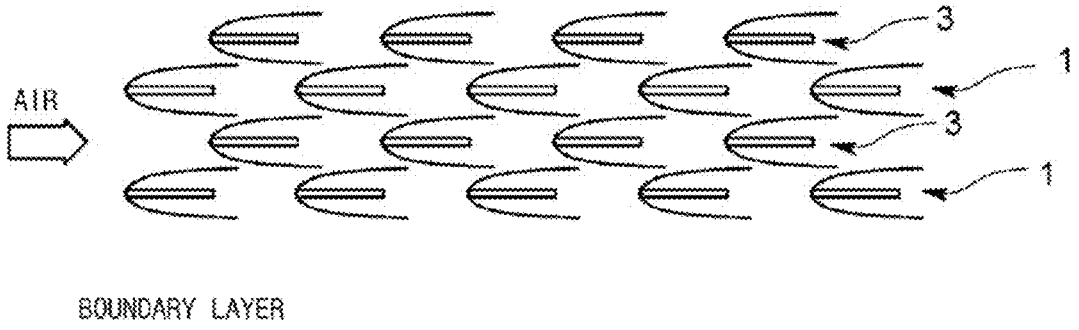
FIGS. 10A and 10B are schematic diagrams showing changes in the heat transfer coefficient and boundary layer formed by a fin and a cut-up member in an embodiment of the disclosure.
Figure 10B:
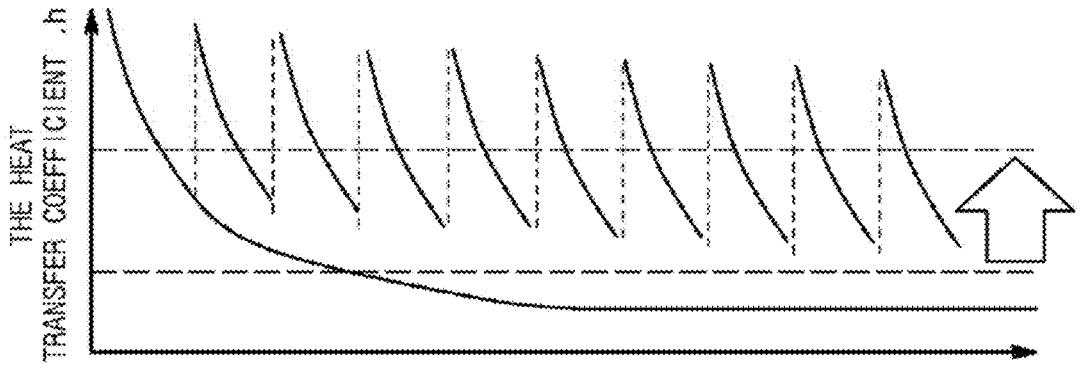

On the other hand as shown in FIGS. 10A and 10B, when the fin 1 is provided with the cut-up member 3, the temperature boundary layer is developed in each of the air inlet ends of the fin 1 and the cut-up member 3. As a result, the heat transfer coefficient at each point is maximized at each air inflow end and repeatedly decreased to the next air inflow end. If the occurrence of such a phenomenon is averaged in each of the cut-up members 3, the heat transfer coefficient becomes larger overall as compared with the fin 1 not provided with the cut-up member 3.

On the other hand, when the cut-up member 3 is formed on the fin 1 and a slit is formed between the flat portion of the fin 1 and the cut-up member 3, the pressure loss becomes larger than the original set pitch.

Here, the effect of improving the heat transfer coefficient by forming the cut-up member 3 and the increase of the pressure loss due to the formation of the cut-up member 3 have different characteristics, respectively. The heat exchanger 100 may be most preferable as long as the increase of the pressure loss can be reduced while the heat transfer coefficient is as large as possible.

Therefore, setting design parameters as the pitch of the fin 1 which is the installation interval of each of the fins 1, and the slit height which is the height of the cut-up member 3 of the fin 1, it is simulated how the ventilation resistance, which causes heat transfer coefficient and pressure loss, would change.

Figure 11:
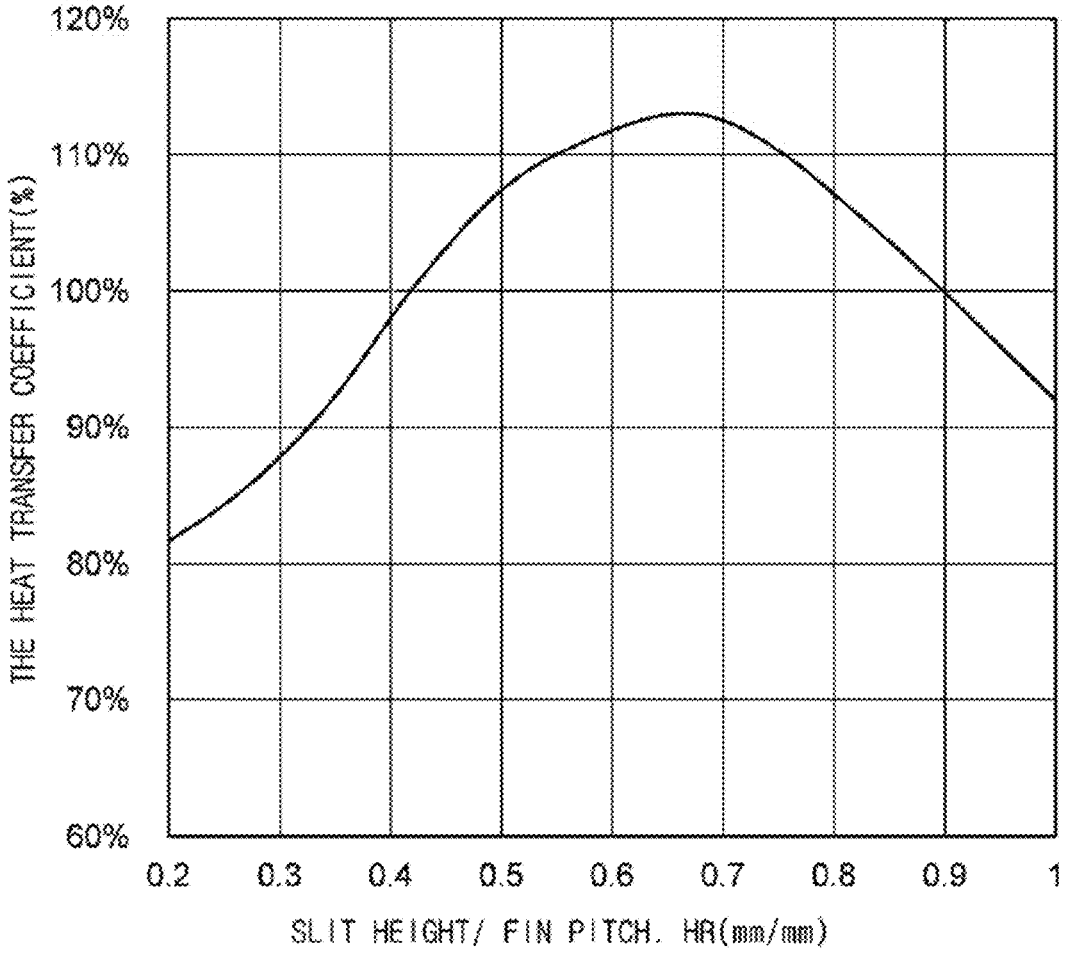
FIG. 11 is a graph showing the relationship between the ratio of the slit height to the fin pitch of a fin and the heat transfer performance in an embodiment of the disclosure.

FIG. 11 is a graph showing the heat transfer performance, which is a ratio to the heat transfer coefficient when the cut-up member 3 is not present when a value HR (slit height)/(the fin 1 pitch) is changed. As seen from FIG. 11, the heat transfer performance becomes the maximum performance at a slit height/the fin 1 pitch HR of about 0.7. The reason for the maximum value at HR=0.7 is that the heat transfer coefficient at the air becomes maximum at an HR of about 0.5 to 0.6, and as the HR becomes larger and the slit height becomes higher, an area of the side surface of the cut-up member 3 becomes larger. This is because the heat transfer performance is a heat transfer coefficient x heat transfer area, resulting in a maximum at around 0.7.

Figure 12:
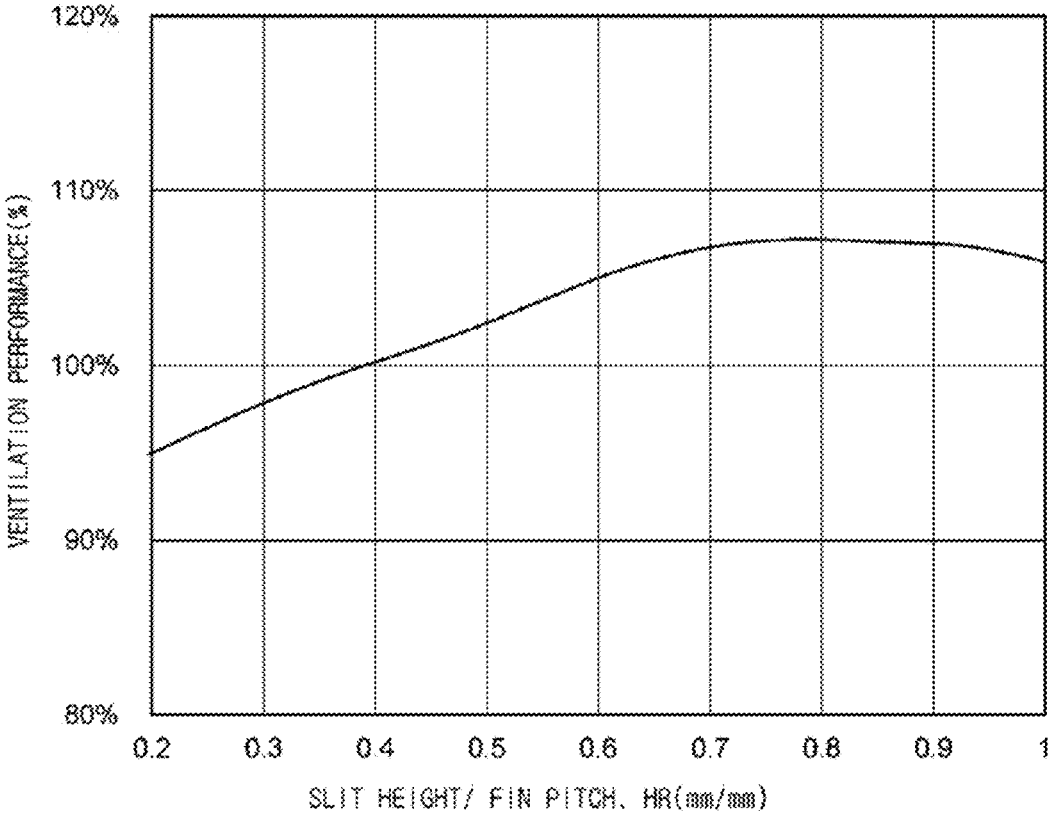
FIG. 12 is a graph showing the relationship between the ratio of the slit height to the fin pitch of a fin and the ventilation resistance in an embodiment of the disclosure.

On the other hand, as shown in FIG. 12, the larger the slit height/the fin 1 pitch, the more the ventilation resistance is increased. This is because the area of the side of the cut-up member 3, which becomes an obstacle against the air flow, increases.

Figure 13:
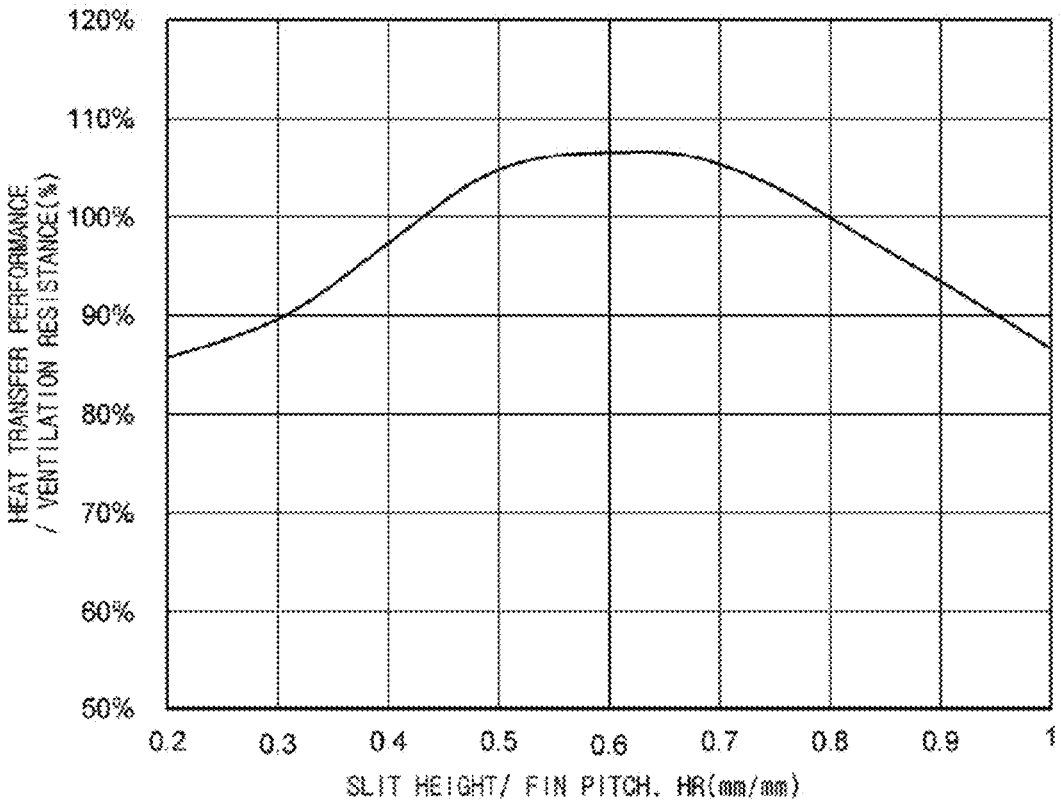
FIG. 13 is a graph showing the relationship between the ratio of the slit height to the fin pitch of a fin and the heat transfer performance with respect to the ventilation resistance in an embodiment of the disclosure.

From the results of these simulations, the HR which may increase the heat transfer performance and reduce the ventilation resistance will be examined. As shown in FIG. 13, when the horizontal axis represents the slit height/the fin 1 pitch and the vertical axis represents the heat transfer performance/ventilation resistance, setting as $0.5 \leq\leq HR \leq\leq 0.7$ is that the heat transfer performance is increased while the ventilation resistance is small when HR set as $0.5 \leq\leq HR \leq\leq 0.7$. Hence, the slit height is set so that the installation spacing of the fins 1 and the height of the cut-up member 3 in the heat exchanger 100 of the present embodiment satisfy $0.5 \leq\leq HR \leq\leq 0.7$.

Next, the performance calculation, when the heat exchanger 100 as described above mounted on the indoor unit 200 of a 4-Way cassette type air conditioner as shown in FIGS. 1 and 2, is performed as following (i), (ii) and (iii).

(i) The diameter of the tube Φ, the number of columns, the number of stages, and the pitch of the fin 1 were changed as parameters.

(ii) Heat transfer coefficient ha on the air side and pressure loss dPa were calculated as follows.

$$h_a = \frac{c_1 \lambda_a Nu}{D_e},$$

$$Nu = 2.1 \times \left(\frac{Pr \mathrm{Re} D_e}{L}\right)^{0.38}$$

$$dP_a = 2\rho_a v_{ac}^2 \left(\frac{fL}{D_e}\right),$$

$$\frac{fL}{D_e} = c_2 \times 0.43 + c_3 \times 35.1 \times \left(\frac{\mathrm{Re} D_e}{L}\right)^{-1.07 \times c_4}$$

c1=1.8, c2=6.142, c3=3.451, c4=1.325, De: Representative length, Nu: Nusselt number, Re: Reynolds number, L: width of the fin 1, f: Flow loss coefficient, Vsc: representative velocity, λa: Thermal Conductivity (Air), Pr: Prandtl number (Air), $\rho_a$: Density (air).

(iii) Heat transfer coefficient href on the refrigerant and pressure loss dPref were estimated using the following interaction equation.

Refrigerant heat transfer coefficient: href: Gungor and Winterton interaction equation; Refrigerant pressure loss: dPref: Lockhart-Martinelli interaction equation.

Based on this premise, the performance evaluation when the heat exchanger 100 of the present embodiment was applied to the indoor unit 200 of the 4-way cassette was simulated for cooling capacities of 2.2 kW to 16 KW.

Figure 14:
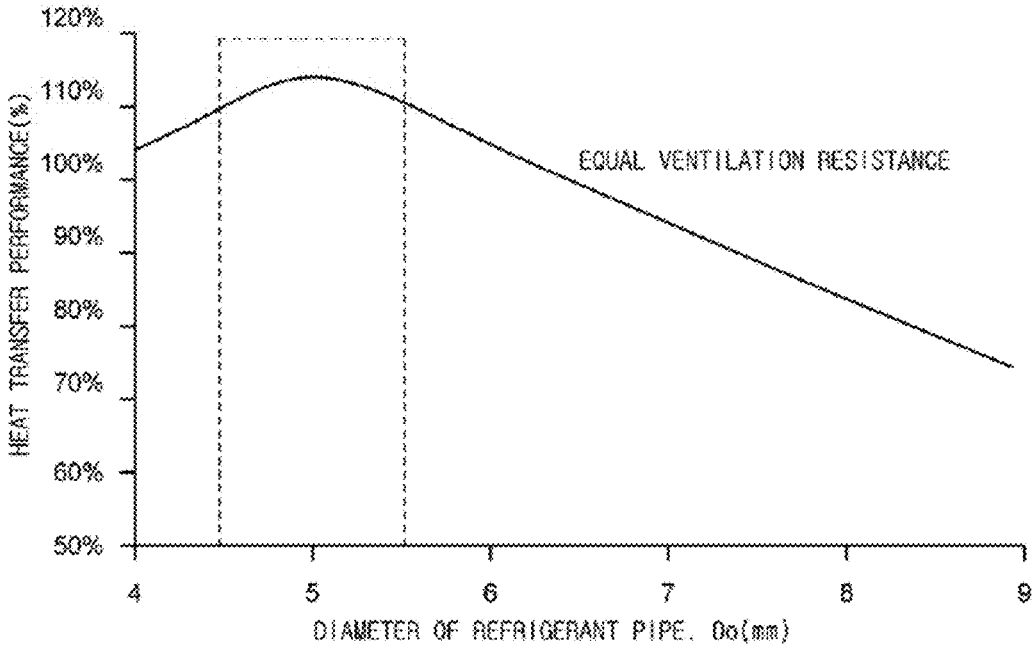
FIG. 14 is a graph showing the relationship between a refrigerant tube and the heat transfer performance with respect to the ventilation resistance in an embodiment of the disclosure.
Figure 15:
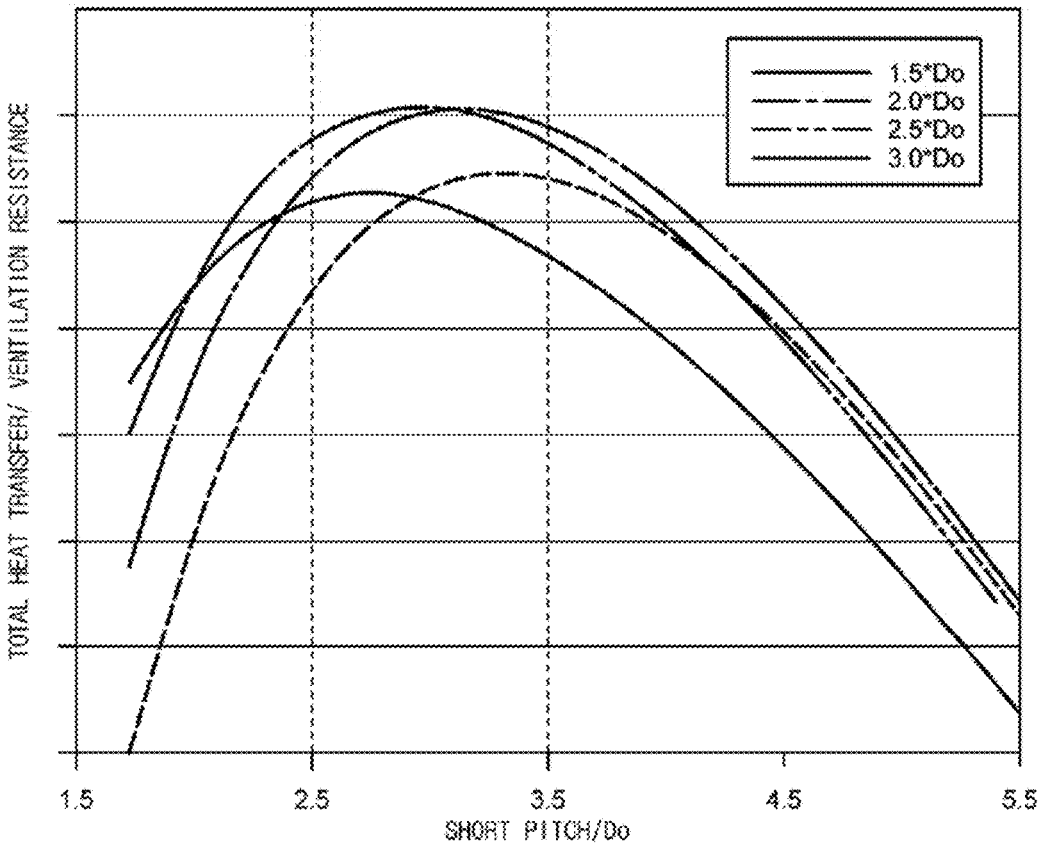
FIG. 15 is a graph showing the relationship between a short pitch and a thermal pitch and the heat transfer performance with respect to the ventilation resistance in an embodiment of the disclosure.

FIG. 14 shows the influence of the pipe diameter on the heat transfer performance, and FIG. 15 shows the simulation results of the heat transfer amount per ventilation resistance when the short pitch Dp and the column pitch Lp are set as parameters.

As shown in FIGS. 14 and 15, the total heat capacity/ventilation resistance is 4.5 mm$\leq\leq$Do$\leq\leq$5.5 mm, the short pitch Dp/relation Do is 2.5 to 3.5, the column pitch Lp/the relation Do is the maximum at 2.0 to 2.5.

Therefore, as the heat exchanger 100 for the indoor unit 200 of the 4-way cassette, the maximum performance may be obtained when the value of the pitch of the slit height/the fin 1 is set in the range of 0.5 to 0.7, diameter Do of the pipe is set in the range of 4.5 mm $\leq\leq$Do$\leq\leq$5.5, the short pitch Dp is set in the range of 2.5Do$\leq\leq$Dp$\leq\leq$3.5Do, and the column pitch Lp is set in the range of 2.0Do$\leq\leq$Lp$\leq\leq$2.5Do.

For this reason, the heat exchanger 100 of the present embodiment constitutes the heat exchanger 100 so as to have the above-described numerical value range. Therefore, the ventilation resistance may be reduced while maximizing the heat transfer performance.

Other embodiments will be described.

Figure 16:
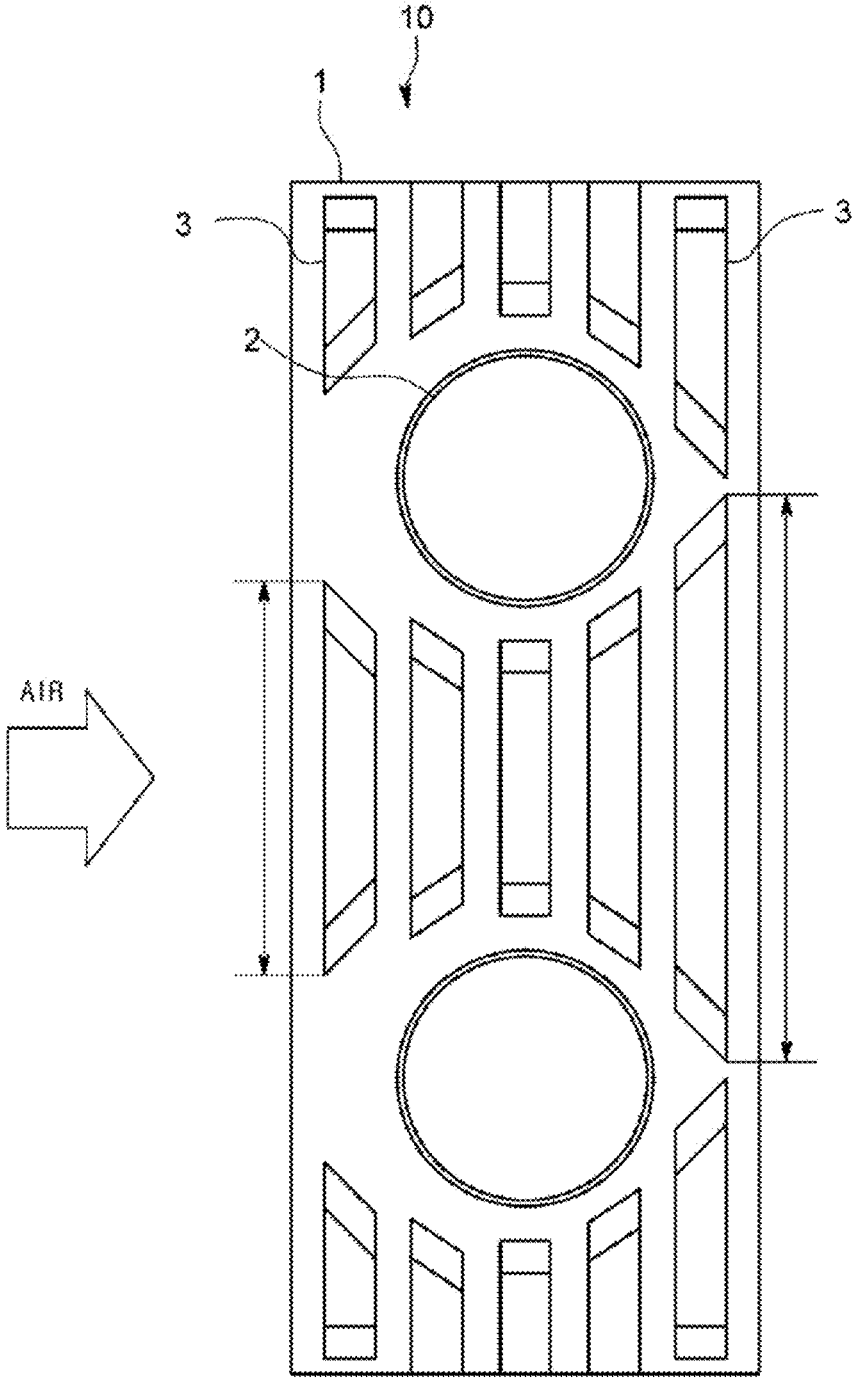
FIG. 16 is a schematic view showing the shape of a fin according to another embodiment of the disclosure.

As shown in FIG. 16, the lengths of the cut-up members 3 formed on the fins 1 in the up and down direction are not substantially the same, but may be different from each other. More specifically, the length in the short direction (up and down direction) of the cut-up member 3 gradually increases from the air inflow side (the left edge side of the fin 1 in FIG. 16) to the air outflow side (the right side edge of the fin 1 in FIG. 16).

That is, the vertical length of the cut-up member 3 disposed on the left edge side of the fin 1 into which the air flows is shorter than the vertical length of the cut-up member 3 disposed on the right edge side of the fin 1.

In other words, the area of the cut-up member 3 formed on the left side of the fin 1 around the refrigerant pipe 2 may be smaller than the area of the cut-up member 3 formed on the right side of the fin 1 around the refrigerant pipe 2.

The cut-up member 3 is formed on the right side of the refrigerant pipe 2 such that the area of the cut-up member 3 is widened on the air outlet side toward the air outlet side to minimize the dead region.

Also, the cut-up member 3 formed on the right edge of the fin 1 with respect to the up and down direction of the fin 1 is positioned adjacent to the center of the cut-up member 3 disposed on the left edge of the fin 1.

As shown in FIGS. 17A to 17F, the cut-up member 3 may not be formed on the entire surface of the fin 1 without a gap, and a portion of the fin 1 may not be provided with the cut-up member 3.

That is, the number of the cut-up members 3 formed on the left edge side of the fin 1 and the number of the cut-up members 3 formed on the right edge side of the fin 1 is different from each other.

Figure 17A:
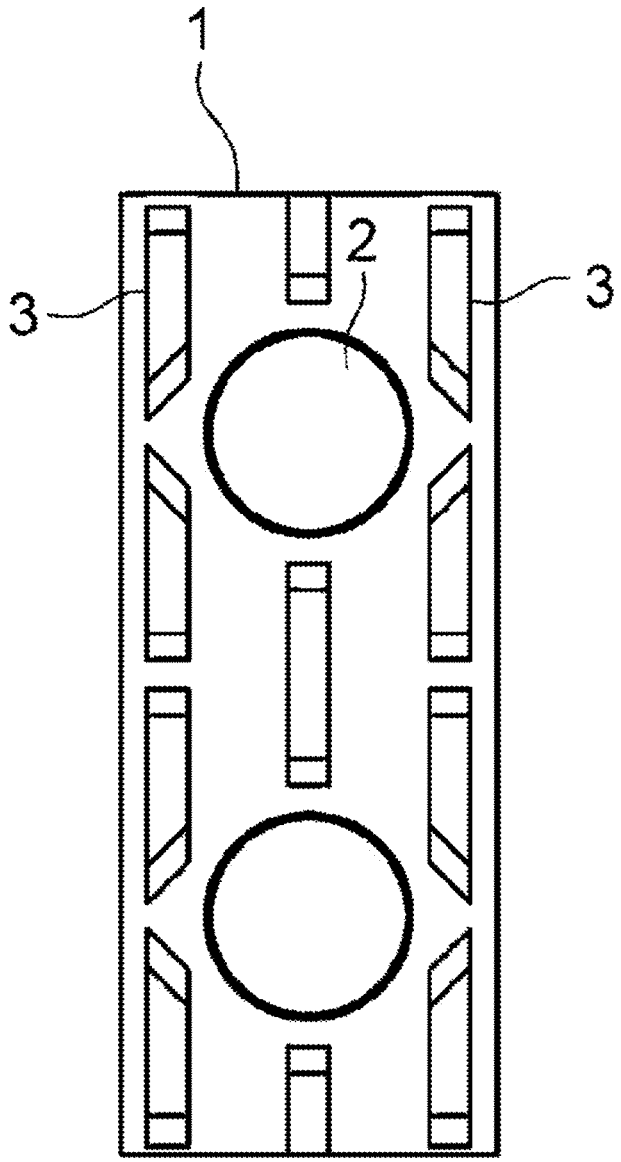
FIGS. 17A to 17F are schematic views showing the shape of a fin according to another embodiment of the present disclosure.
Figure 17B:
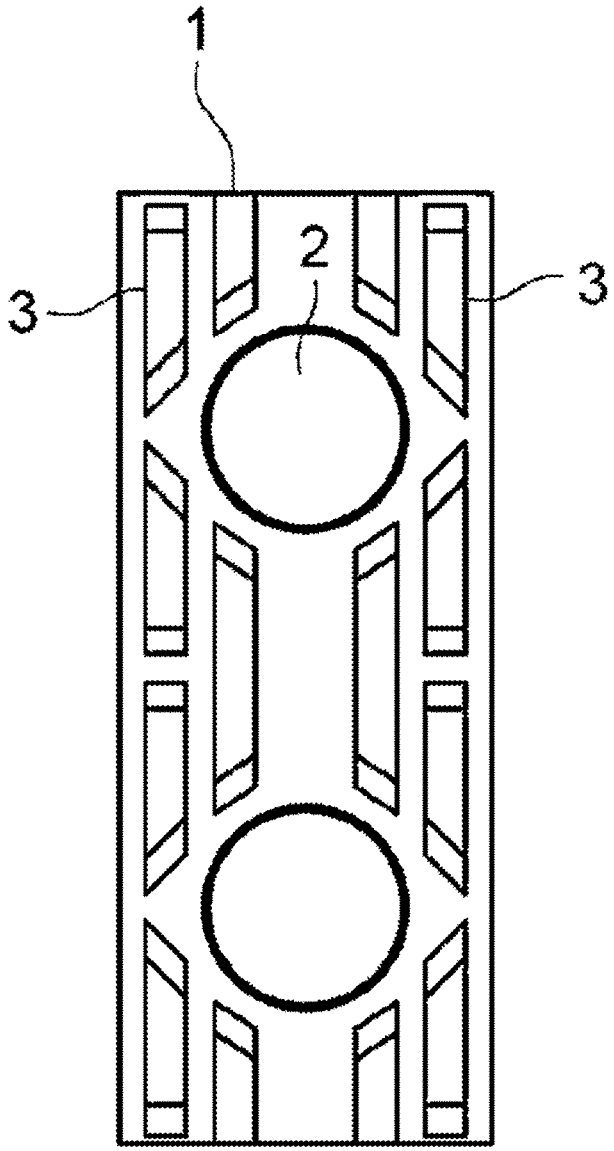
Figure 17C:
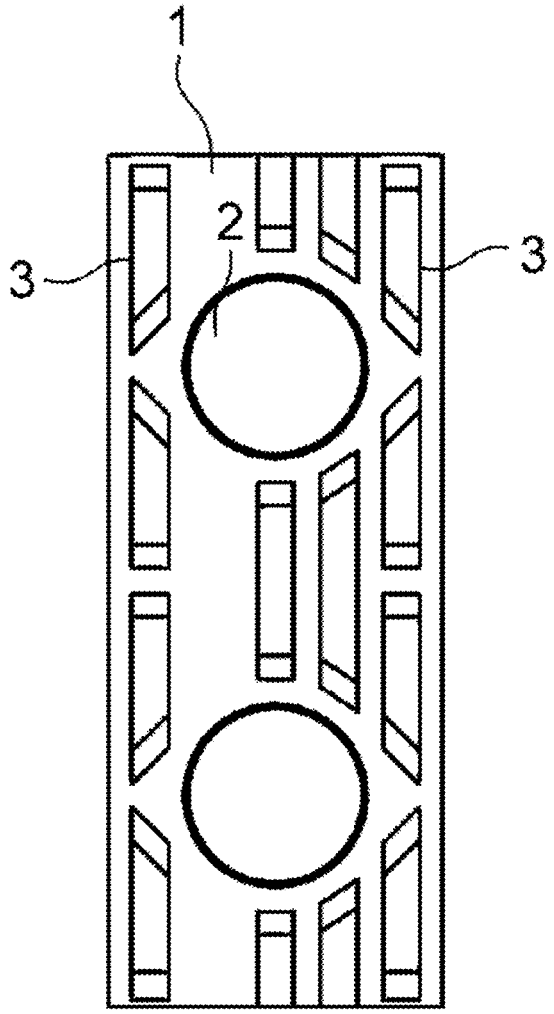
Figure 17D:
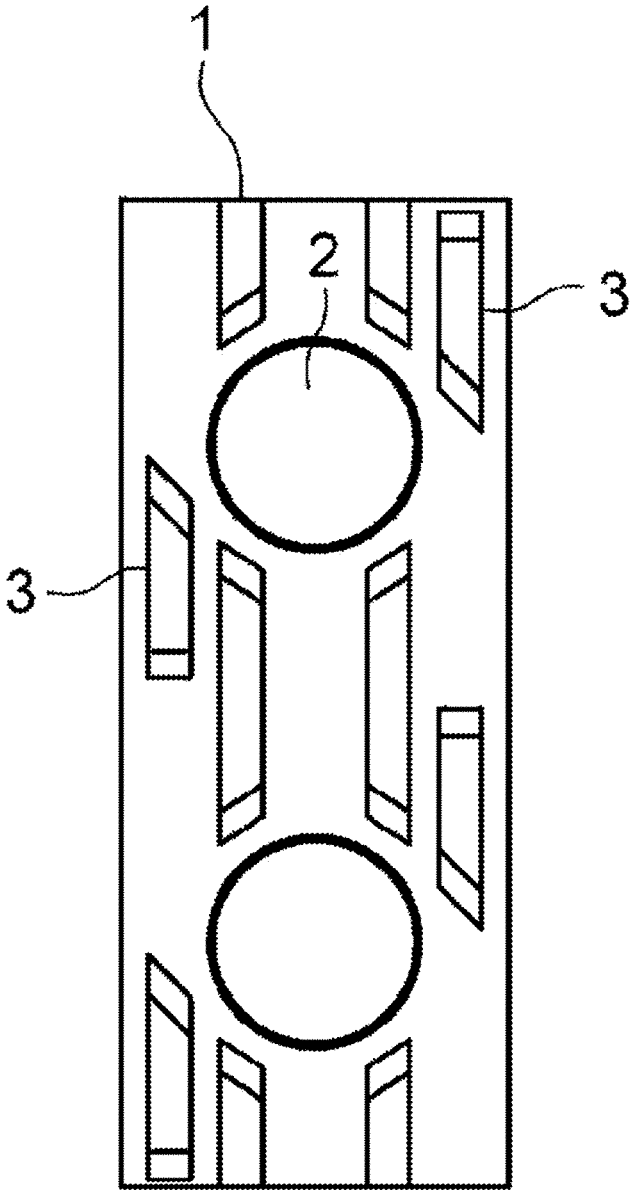

For example, as shown in FIG. 17C, the number of cut-up members 3 formed on the right edge of the fin 1 is larger than the number of the cut-up members 3 formed on the left edge of the fin 1 in order to minimize the dead region of the fin 1 so that the flow of air flowing toward the air outflow side may be controlled.

Figure 17E:
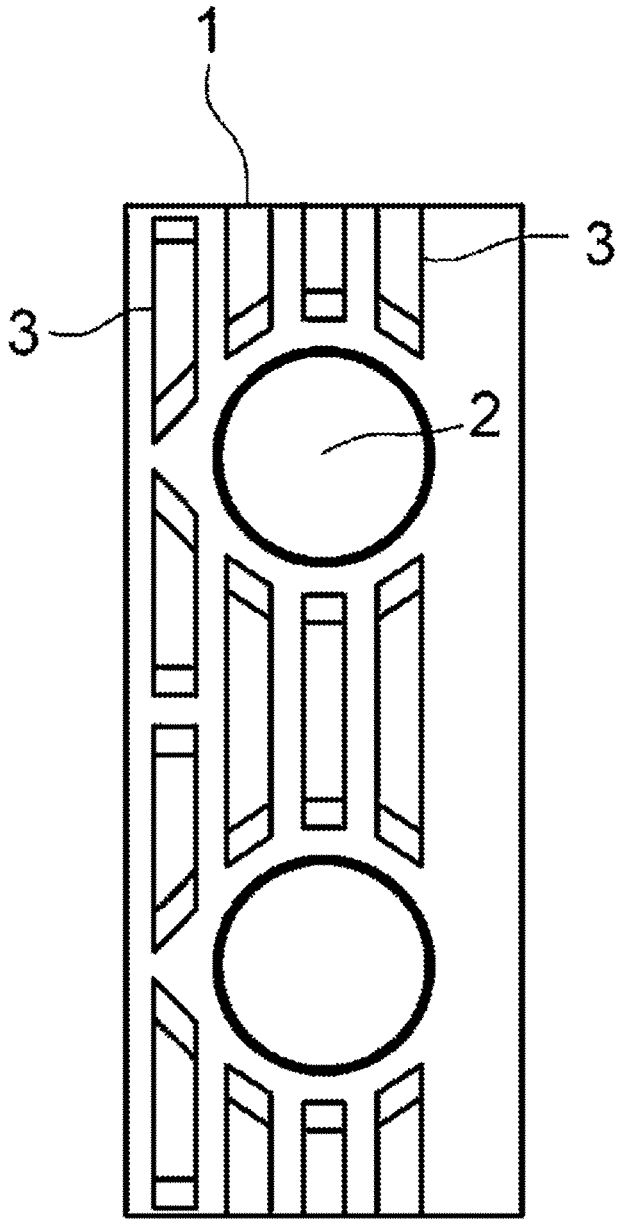
Figure 17F:
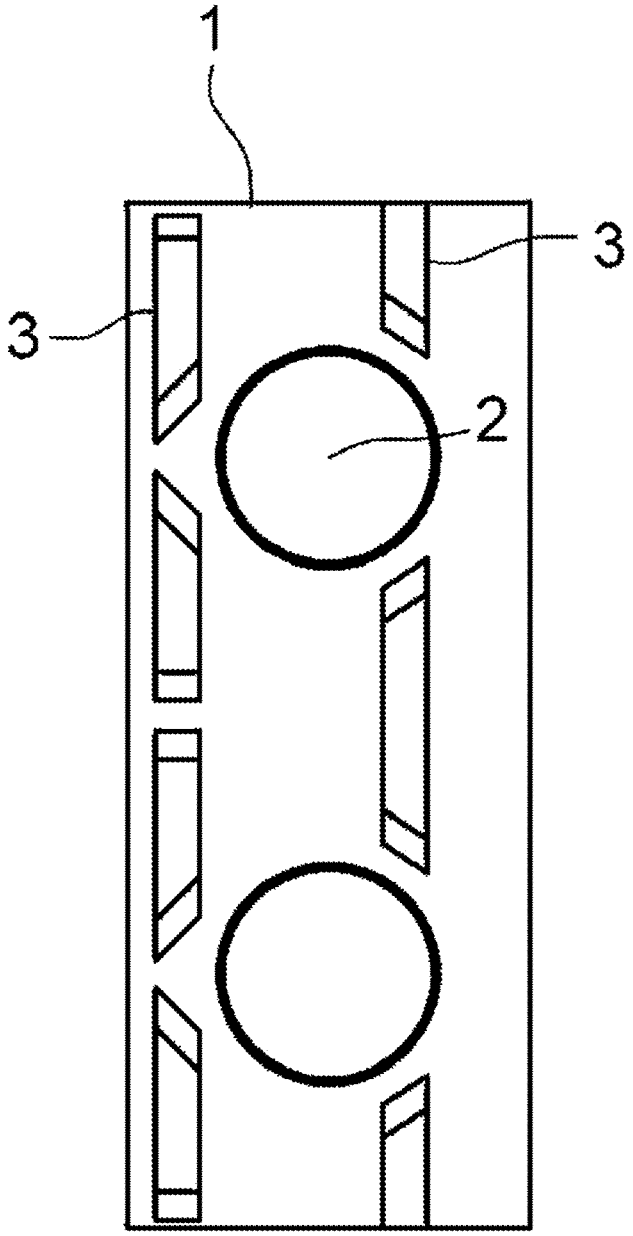

However, the present disclosure is not limited to this, and the number of the cut-up members 3 may be reversed as shown in FIG. 17E.

Also, in order to achieve the predetermined performance as the heat exchanger 100, the slit height is set such that the value HR of (slit height)/(the fin 1 pitch) is $0.5 \leq\leq HR \leq\leq 0.7$. Also, the heat exchanger 100 may be used not only in the air conditioner but also in other refrigeration cycle devices such as a refrigerator. It may be used not only as an indoor unit but also as an outdoor unit.

Other combinations and modifications of the various embodiments may be made without departing from the spirit of the present invention.

The invention claimed is:

1. An air conditioner including a heat exchanger, the heat exchanger including a plurality of refrigerant pipes and a plurality of fins, wherein the plurality of the refrigerant pipes includes:

a first refrigerant pipe and a second refrigerant pipe spaced apart from each other in a first direction that is an extension direction of the plurality of fins, and a third refrigerant pipe spaced apart from the first refrigerant pipe in a second direction perpendicular to the first direction, wherein a distance from a center of the first refrigerant pipe to a center of the third refrigerant pipe in the second direction is defined as Lp, and wherein the plurality of fins including:

a first fin and a second fin which are spaced apart from each other in an extension direction of the refrigerant pipe, and a third fin aligned with the first fin in a column direction, wherein a width of the first fin and a width of the third fin in the column direction is equal to the distance from the center of the first refrigerant pipe to a center of the third refrigerant pipe in the second direction, wherein the first fin includes a flat portion and a plurality of cut-up members protruding in an arrangement direction of the second fin in the flat portion, wherein rows of the plurality of cut-up members are arranged on the flat portion asymmetrically with respect to a longitudinal centerline extending in the first direction of the flat portion, wherein a width of the cut-up member in the second direction is a fourth of an outer diameter of the first refrigerant pipe, wherein an angle formed by an upper portion and an angle form by a lower portion of a cut-up member in relation to the second direction increase for each cut-up member from the longitudinal centerline to a respective edge of a fin in the second direction, wherein the plurality of cut-up members includes a first cut-up member adjacent to the respective edge of the fin, and a second cut-up member disposed closest to the first cut-up member in the second direction, wherein an angle of a line connecting an upper portion of the first cut-up member and an upper portion of the second cut-up member in relation to the second direction is greater than an angle formed by the upper portion of the first cut-up member in relation to the second direction and an angle formed by the upper portion of the second cut-up member in relation to the second direction, wherein an angle of a line connecting a lower portion of the first cut-up member and a lower portion of the second cut-up member in relation to the second direction is greater than an angle formed by the lower portion of the first cut-up member in relation to the second direction and an angle formed by the lower portion of the second cut-up member in relation to the second direction, wherein each of the plurality of fins includes a gap downstream of a respective refrigerant pipe between adjacent cut-up members, wherein the adjacent cut-up members are disposed such that an air inlet side of the gap is larger than an air outlet side of the gap, wherein an upper end or a lower end of a cut-up member disposed on the air outlet side is disposed to reduce a dead region, and wherein a height of each cut-up member in the extension direction is between 0.5 and 0.7 times a distance between the first fin and the second fin.

2. The air conditioner of claim 1, wherein a diameter for each of the plurality of refrigerant pipes is defined as D, and the diameter for each of the plurality of refrigerant pipes satisfies $4.5\ mm \leq D \leq 5.5\ mm$.

3. The air conditioner of claim 2, wherein a distance from a center of the first refrigerant pipe to a center of the second refrigerant pipe is defined as Dp, and the distance from the center of the first refrigerant pipe to the center of the second refrigerant pipe satisfies $D*2.5 \leq Dp \leq D*3.5$.

4. The air conditioner of claim 3, wherein the distance from the center of the first refrigerant pipe to the center of the third refrigerant pipe in the second direction satisfies $D*2.0 \leq Lp \leq D*2.5$.

5. The air conditioner of claim 1 wherein:

each cut-up member includes a body portion spaced apart from the flat portion so that a slit is formed between the flat portion and a cut-up member, and an end portion connected to the flat portion at both ends of the body portion, and the end portion is formed to be inclined from 40 to 50 degrees with respect to the flat portion.

6. The air conditioner of claim 5, wherein the plurality of cut-up members protrude from only one side of the flat portion.

7. The air conditioner of claim 5, wherein:

the first fin further includes a through hole through which the first refrigerant pipe passes, a plurality of body portions of the plurality of cut-up members extend in a direction corresponding to a longitudinal direction of the first fin, and a plurality of end portions of the plurality of cut-up members is provided so as to surround a periphery of the through hole.

8. The air conditioner of claim 7, wherein the longitudinal direction of the first fin is defined as the first direction and a direction being perpendicular to the first direction in which air flows into the heat exchanger is defined as the second direction.

9. The air conditioner of claim 1, wherein the angle formed by the upper portion of the first cut-up member or the angle formed by the lower portion of the first cut-up member is formed between 20 degrees and 50 degrees with respect to the second direction.

10. The air conditioner of claim 7, wherein each of the plurality of cut-up members protrude at a same height with respect to the flat portion.

* * * * *